US005839995A

United States Patent [19]

Chen

[11] Patent Number: 5,839,995

[45] Date of Patent: Nov. 24, 1998

[54] MULTI-FUNCTIONAL HEALTH DEVICE

[76] Inventor: Ko-Chuan Chen, 7F-2, No. 95-8 Chang Ping Road Sec.1, Taichung, Taiwan

[21] Appl. No.: 546,965

[22] Filed: Oct. 23, 1995

[51] Int. Cl.[6] ..... A63B 21/00; A61H 1/00

[52] U.S. Cl. ..... 482/92; 482/45; 482/62; 482/138; 482/142; 482/904; 601/33; 601/36; 280/304.1

[58] Field of Search ..... 482/45, 62, 92, 482/136, 137, 138, 142, 904, 148, 51; 601/33, 36, 23; 280/304.1

[56] References Cited

U.S. PATENT DOCUMENTS

| | | | |
|---|---|---|---|
| 2,735,422 | 2/1956 | Jones | 601/36 |
| 3,754,547 | 8/1973 | Walker | 482/121 |
| 4,153,244 | 5/1979 | Tauber, Jr. | 482/904 |
| 4,690,364 | 9/1987 | Constantin | 280/304.1 |
| 4,747,595 | 5/1988 | Mabry et al. | 482/99 |
| 4,880,227 | 11/1989 | Sowell | 482/102 |
| 4,907,798 | 3/1990 | Burchatz | 482/99 |
| 4,911,435 | 3/1990 | Johns | 280/304.1 |
| 4,993,407 | 2/1991 | Chen | 601/36 |
| 5,026,225 | 6/1991 | McIntyre | 280/301.1 |
| 5,100,128 | 3/1992 | Mabry et al. | 482/137 |
| 5,277,685 | 1/1994 | Gonzales | 601/23 |

*Primary Examiner*—Richard J. Apley
*Assistant Examiner*—Victor K. Hwang

[57] ABSTRACT

A multi-functional health device comprises a frame support, a pedal assembly connected by wires with a pair of hand pullers, a hand wheel, a crank member, a torsion member and a pair of positioning plates operably disposed on respective positions of the support, which provide whole bodied exercise to a crippled or abled person for their subsidiary medical treatment. A pair of extensions extend parallel from the front side of the lower frame in cooperation with a plurality of belts and enables a wheelchair to be stably fastened therebetween for facilitating a ready access of a crippled person to the device.

12 Claims, 4 Drawing Sheets

MULTI-FUNCTIONAL HEALTH DEVICE

BACKGROUND OF THE INVENTION

The present invention relates to health apparatus and more particularly to a multi-functional health device which is a combination of various health apparatuses for accommodating the health exercises on different portions of the human body.

For curing or recovery of crippled, wounded or disabled people in subsidiary medical treatment, or for the recreative exercise of the aged people, there are a lot of different health apparatuses on the market. Each of those health apparatuses provides a single device to cure a particular portion of the human body such as hands, arms, legs, etc. If a crippled person needs to cure several portions of his body, he needs to buy more than one of those apparatuses to accommodate his requirement, thus, wasting money and space to install as well. Therefore, a combination of several health apparatuses together in a single device is a trend of manufacturing of health device.

SUMMARY OF THE PRESENT INVENTION

The present invention has a main object to provide a multi-functional health device which accommodates the health exercises on different portions of the human body.

Another object of the present invention is to provide a multi-functional health device which has a simple structure and releasably secured elements that facilitates a ready assembly or disassembly of the device.

Still another object of the present invention is to provide a multi-functional health device which saves space for installation and facilitates easy movement or transportation.

Accordingly, the multi-functional health device of the present invention comprises generally a support composed of an upper frame and a lower frame, a pedal assembly actuated by a motor having a pair of foot plates which are connected to a pair of hand pullers respectively via a pair of wires and hung on a pair of pulleys from the upper frame, a hand wheel rotatably secured to one of the lateral sides of the lower frame, a crank member adjacent a torsion member rotatably secured to the other lateral side, and a pair of extensions extending parallel from the front side of the lower frame, each including a retaining ring with belts for fastening a wheelchair when it enters into the extensions therebetween. The device further has a pair of positioning plates with retaining means releasably secured to the rear side of the support which are adapted to secure a human body standing there against the device.

The present invention will become more fully understood by reference to the following detailed description thereof when read in conjunction with the attached drawings.

DETAILED DESCRIPTION OF THE PREFERRED EMBODIMENT

Figure 1:
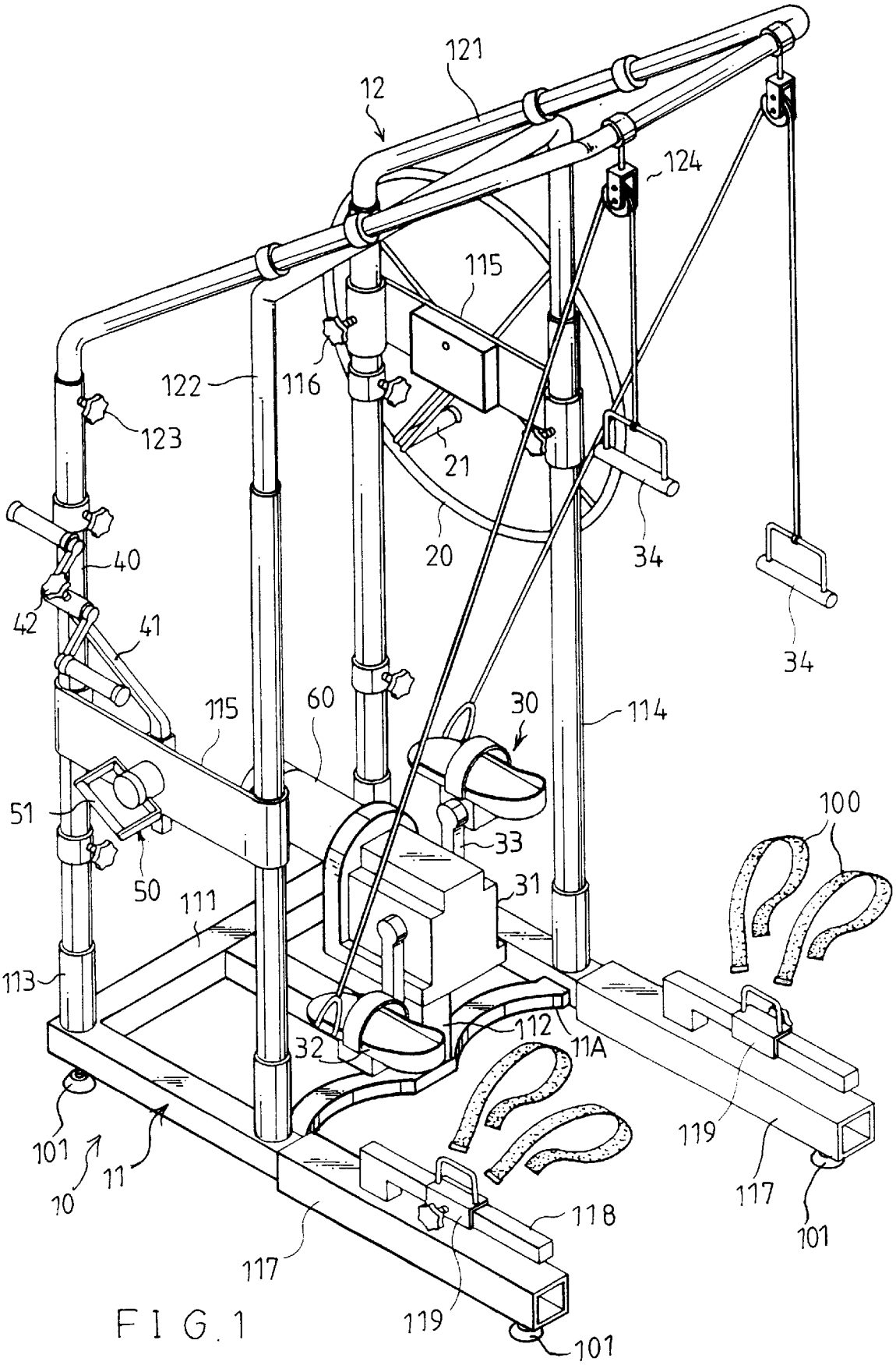
FIG. 1 is a perspective view to show a preferred embodiment of the present invention.

With reference to FIG. 1 of the drawings, the multi-functional health device of the present invention comprises generally a support 10 composed of a lower frame 11 and an upper frame 12, a hand wheel 20, a pedal assembly 30, a crank member 40, a torsion member 50 and a motor 60.

The lower frame 11 comprises a rectangular base 111 having a central reinforcement abutting a protrusion 112 projected upward therefrom, a pair of introversions 11A on the front side and four tubular cavities 113 projected upward from the four corners for releasable coupling four cylinder uprights 114 respectively, the lateral sides of the lower frame have been reinforced by a pair of cross bars 115 which has a sleeve on each end wrapped on each two of the uprights 114 from front side to the rear side of the lower frame 11 and fastened by means of bolts 116. The cross bars are positioned at different levels so as to facilitate disposition of various health apparatuses thereon.

The upper frame 12 is composed of two roughly U-shape rods 121 and 122 with the rod 121 slopedly connected to the top of the rod 122. The free ends of the rod 121 are bent downwardly in alignment with the rear side of uprights 114 of the lower frame 11, such that the upper frame 12 is releasably coupled to the four uprights 114 of the lower frame 11 and fastened by mean of bolts 123. The upper frame 12 further has a pair of pulleys 124 suspended spaced apart from the front side.

The hand wheel 20 has a pivotal handle 21 on the rim abutting a spoke and a central axis rotatably connected to an electrical driver 22 through the cross bar 115, so that the hand wheel 20 is swing by hand or actuated to swing by the electrical driver 22. The hand wheel 20 is provided to cure shoulders of crippled people.

The pedal assembly 30 secured to the protrusion 112 comprises a driving member 31, a pair of foot plates 32 pivotally secured to a pair of cranks 33 respectively and connected to a pair of hand pullers 34 by wires. The wires are suspended from the pair of pulleys 124 so that the pullers 34 can be acted upon synchronously with the foot plates 32. The pedal assembly 30 can be manually operated by an abled man or actuated to operate by a motor 60 when applied to a disabled man at a predetermined speed.

The crank member 40 which is roughly W-shaped and has a handle at each opposite end and pivotally connected to a T-shape sloped protrusion 41 projected from the inner side of the cross bar 115. A bolt 42 is operated to adjust the friction force applied to the crank member 40, so that the crank member 40 provides various resistive force to the user who uses it. The crank member 40 is operated by two hands of an abled or a crippled man for the exercise of their arms.

The torsion member 50 is disposed to the outer surface of the cross bar 115 which is composed of a rectangular handle driver 51 connected to a torsional axis. The axis is rotatably secured to a cylindrical housing and biased by spring which provides predetermined torsion force for the exercise of the wrist of the user who twists it.

Figure 2:
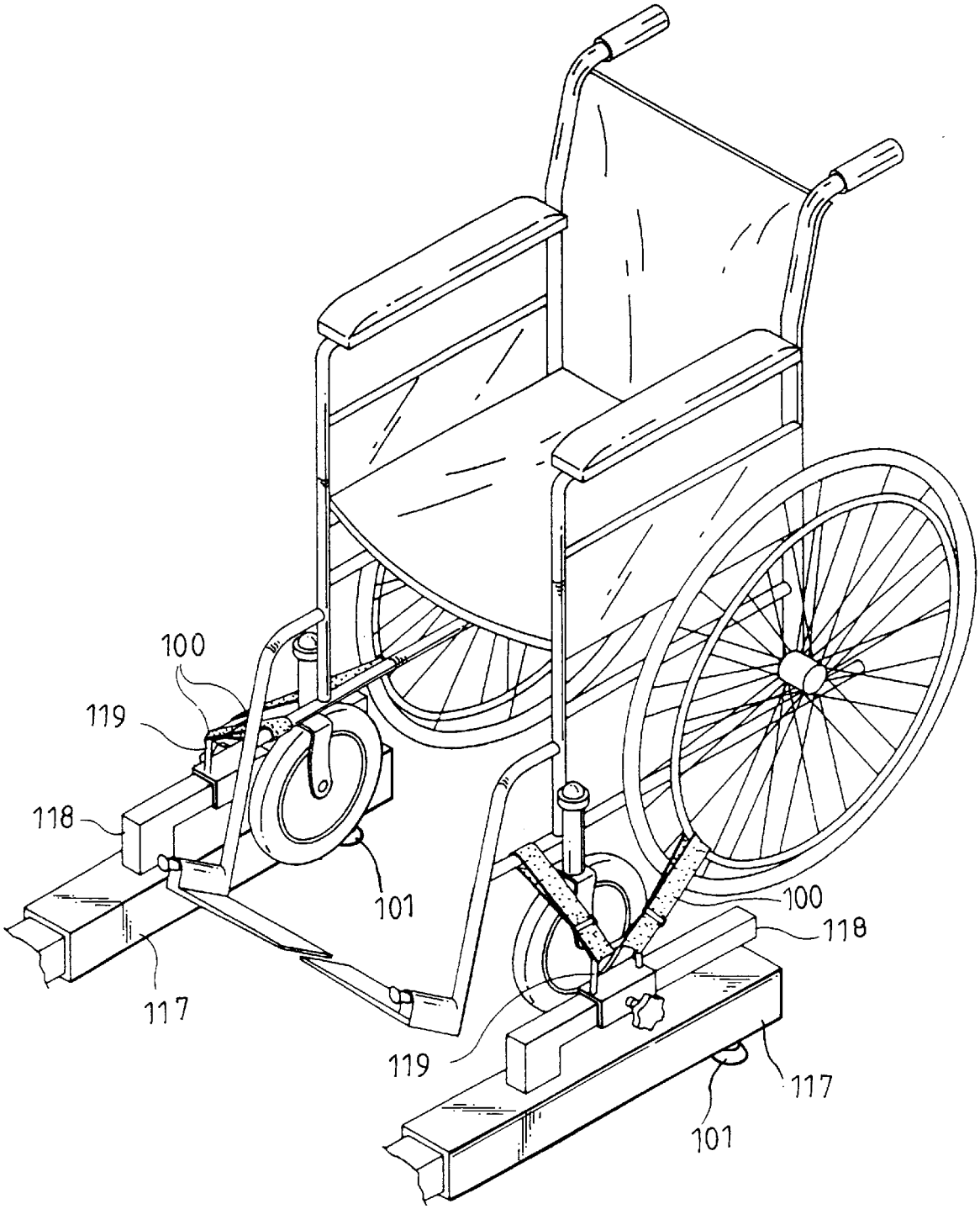
FIG. 2 is a perspective view to show a wheelchair positioned between the pair of extensions and fastened by the belts.

The lower frame 11 further has a pair of extensions 117 extended parallel from the front side of the base 111. Each of the extensions 117 has an L-shape member 118 integrated thereon, a retaining ring 119 displaceably sleeved on the L-shape member 118 and a pair belts or straps 100 made of hook and loop material which are prepared to fasten a wheelchair on the retaining rings 119 as shown in FIG. 2. When the wheelchair is fastened, the retaining ring 119 can be transversely displaceable on the L-shape member 118 to accommodate the crippled with the pedal assembly 30. In practice, the crippled places his foot on the foot plates 32 and applies his hands to the hand pullers 34 respectively, then applies proper strength to the foot plates to rotate the cranks 33 so as to synchronously effect the hands on the hand pullers to move up and downward alternately. If the crippled is unable to move the pedal assembly 30 himself, the motor 60 will turn on to actuate the driving member 31 to rotate the pedal assembly 30 at a predetermined speed. There are a plurality of foot stands 101 adjustably secured to the corners on the bottom of the lower frame 11.

Figure 3:
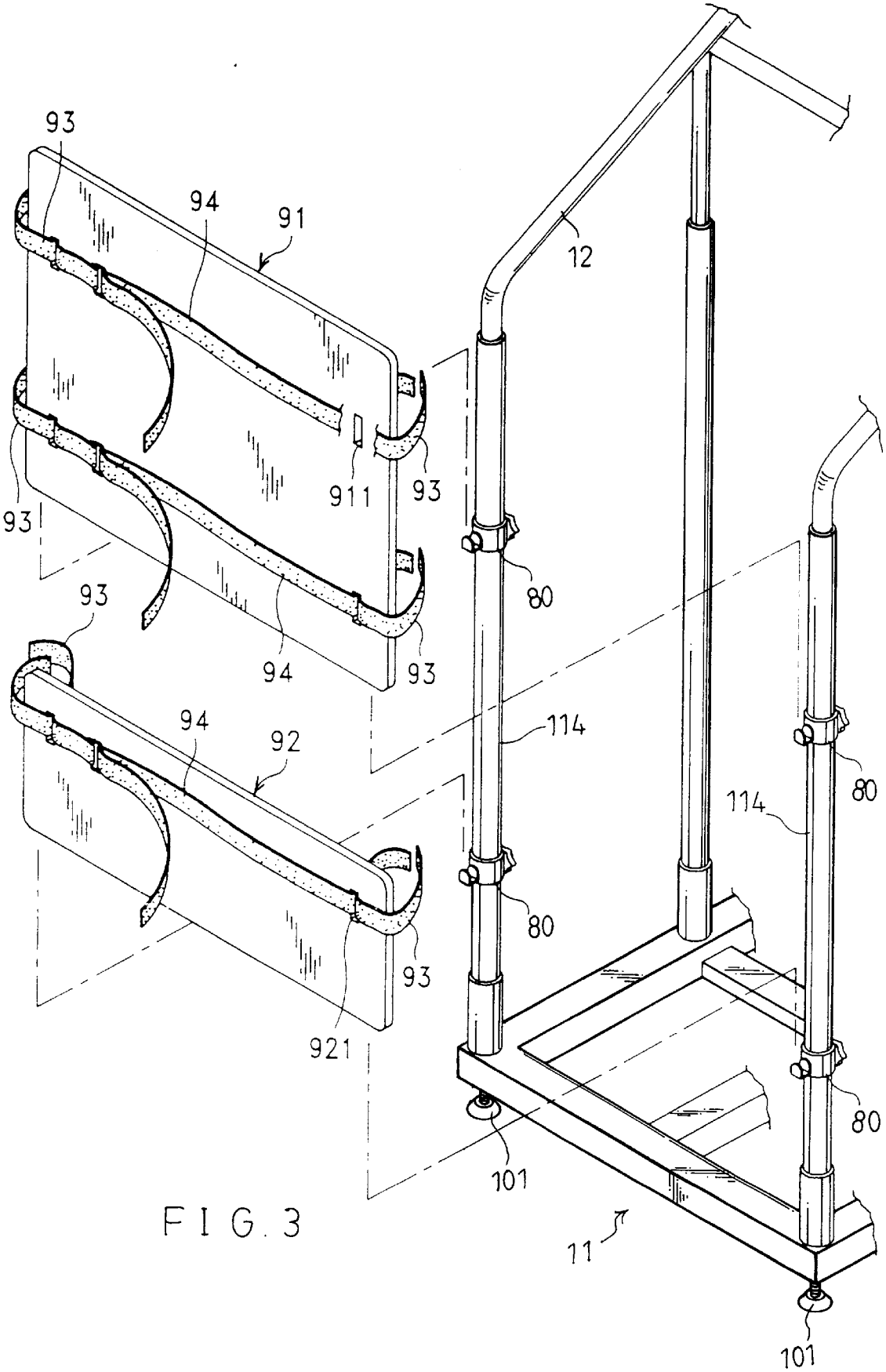
FIG. 3 is an exploded perspective view to show the positioning plates secured to the rear side of the device.
Figure 4:
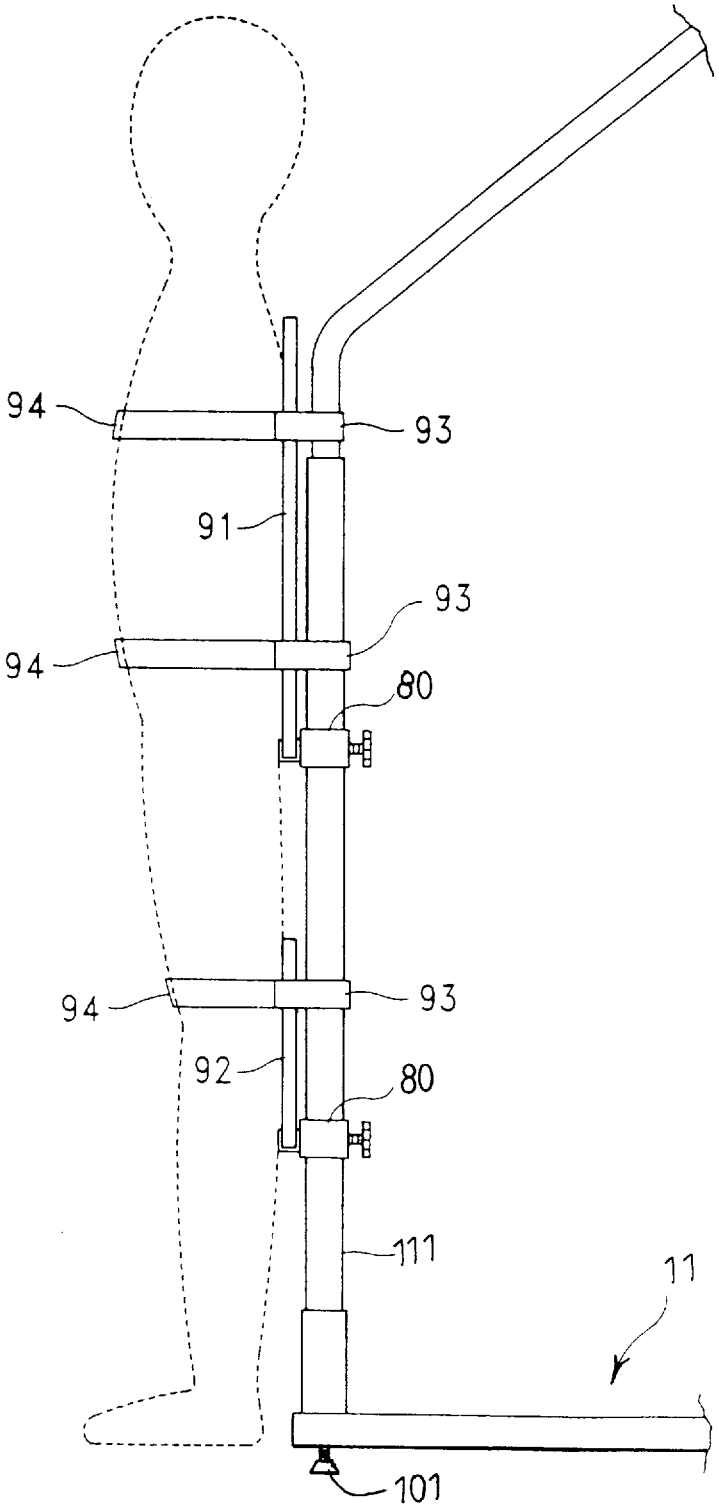
FIG. 4 is a side elevation indicating a standing human body secured to the pair of positioning plates.

Referring to FIG. 3 of the drawings, the multi-functional health device of the present invention further has a pair of positioning plates 91 and 92 fastened spaced apart on the rear side of the lower frame 11. The first positioning plate 91 has two pairs of spaced slots 911 and the second positioning plate 92 which is smaller than the first positioning plate 91, has a pair of spaced slots 921 adjacent the lateral edges thereof. Each slot 911 and 921 is provided to retain a short belt 93 and a long belt 94. The belts 93 and 94 may be straps made from hook and loop material. The short belts 93 are used to fasten the plates 91 and 92 on a plurality of hook members 80 displaceably secured on a pair of rear uprights 114 of the lower frame 11, where the long belts 94 are used to fasten a crippled who stands there uprightly for health exercise as shown in FIG. 4.

Since all elements of the health device of the present invention are releasable and adjustable, it is advantageous to pack for transportation. Furthermore, a multi-functional health device is economical and facilitates a crippled or abled man for whole bodied exercises.

Note that the specification relating to the above embodiment should be construed as to exemplary rather than as to limitative of the present invention, with many variations and modifications being readily attainable by a person of average skill in the art without departing from the spirit or scope thereof as defined by the appended claims and their legal equivalents.

I claim:

1. The multi-exercise health apparatus for disabled people, the apparatus comprising:

a frame having a lower frame and an upper frame;

said frame supporting a plurality of exercise structure for exercising various parts of the user's body;

said lower frame being generally rectangular in shape with four corners, a front side, a back side, and a central reinforcement extending between the front side and the back side;

each corner of said lower frame having an upright extending generally upward to support said upper frame;

a first cross bar adjustably mounted to a first front and back pair of said uprights to support at least one of said plurality of exercise structure at a selectable height;

a second cross bar adjustably mounted to a second front and back pair of said uprights to support at least one of said plurality exercise structure at a selectable height;

said upper frame comprising a first and a second U-shaped rod;

each said U-shaped rod having a pair of free ends releasably engaged to a respective pair of said uprights located on said lower frame;

said first U-shaped rod bent at its ends to allow said second U-shaped rod to support said first U-shaped rod;

a wheelchair securing means located on the front side of said lower frame to secure a user's wheelchair into a position for accessing at least one of said plurality of exercise structure;

said wheelchair securing means comprising a pair of extensions extending parallel from the front said of said lower frame; and each said extension having an L-shaped member on an upper surface, a retaining ring displacably secured to said L-shaped member, and at least one belt for releasably fastening a wheelchair to said retaining ring, whereby the user is able to engage at least one of said exercise structure from the wheelchair and the wheelchair is releasably secured between said pair of extensions.

2. The multi-exercise health apparatus of claim 1 wherein said plurality of exercise structure includes:

a hand wheel having a central axis pivotally connected to said first cross bar and an electrical driver connected to said central axis of said hand wheel; and said hand wheel comprising a spoke, a rim abutting the spoke, and a handle on the rim.

3. The multi-exercise health apparatus of claim 1 wherein said plurality of exercise structure includes:

a pedal assembly secured to a protrusion abutting the central reinforcement of said lower frame; and said pedal assembly comprising a driving member, a pair of cranks pivotally connected to said driving member, each crank having a footplate, each footplate connected to hand puller by a wire passing over one of a pair of pulleys suspended from said second U-shaped rod, and a motor connected to said driving member to actuate rotation of said cranks.

4. The multi-exercise health apparatus of claim 1 wherein said plurality of exercise structure includes:

a crank member pivotally connected to a T-shaped protrusion extending upward, at an angle, from an inner surface of said second cross bar; and said crank member adjustably secured to said T-shaped protrusion by a bolt.

5. The multi-exercise health apparatus of claim 1 wherein said plurality of exercise structure includes:

a torsion member secured to an outer surface of said second cross bar; and said torsion member comprising a rectangular handle having an axis pivotally secured to a cylindrical housing and biased by a spring.

6. The multi-exercise health apparatus of claim 1, further comprising a plurality of hook members displacedly secured to said uprights located on the back side of said lower frame; and said hook members releasably fastened to a first and a second positioning plate.

7. The multi-exercise health apparatus of claim 6, wherein said first positioning plate includes two pairs of spaced slots located adjacent lateral edges thereof;

said second positioning plate is smaller than said first positioning plate;

said second positioning plate includes a pair of spaced slots located adjacent lateral edges thereof; and each pair of slots of said first and second positioning plates retaining a long belt and a pair of short belts, whereby the short belts secure the plates to the uprights and the long belts secure a user to the positioning plates.

8. A multi-exercise health apparatus comprising:

a support including a lower frame and an upper frame releasably coupled to said lower frame;

said lower frame comprising a rectangular base having four corners, a back side, a front side, and a central reinforcement spanning said front and said back sides;

said front side having a pair of introversions;

said central reinforcement abutting a protrusion;

each said corner having a tubular cavity projecting upward therefrom and each tubular cavity having an upright releasably secured thereto;

a first and a second cross bar, each cross bar having two ends, and each end having a sleeve wrapped about one of the uprights such that said cross bars span a pair of said uprights from the front side lower frame to the back side of said lower frame;

said upper frame comprising a first and a second U-shaped rod;

each U-shaped rod having a pair of free ends releasably engaged to a respective pair of said uprights located on said lower frame;

said first U-shaped rod bent at its ends to allow said second U-shaped rod to support said first U-shaped rod;

said second U-shaped rod having a pair of pulleys suspended from a front end thereof;

a hand wheel having a central axis pivotally connected to said first cross bar and to an electrical driver;

said hand wheel comprising a spoke, a rim abutting the spoke, and a handle on the rim;

a pedal assembly secured to said protrusion;

said pedal assembly comprising a driving member, a pair of cranks pivotally connected to said driving member, each crank having a footplate, each footplate connected to a hand puller by a wire suspended by one of said pulleys, and a motor connected to said driving member to actuate rotation of said cranks;

a crank member pivotally connected to a T-shaped protrusion extending upward from an inner surface of said second cross bar at an angle;

said crank member adjustably secured to said T-shaped protrusion by a bolt;

a torsion member secured to an outer surface of said second cross bar;

said torsion member comprising a rectangular handle having an axis pivotally secured to a cylindrical housing and biased by a spring;

a pair of extensions extending parallel from the front side of said lower frame;

each said extension having an L-shaped member on an upper surface, a retaining ring displaceably secured to said L-shaped member, and a pair of belts for releasably fastening a wheelchair to said retaining ring, whereby the wheelchair is releasably secured between said pair of extensions.

9. The multi-exercise health apparatus of claim 8, further comprising a plurality of hook members displaceably secured to the pair of said uprights located on the back side of said lower frame, said hook members releasably fastened to a first and a second positioning plate.

10. The multi-exercise health apparatus of claim 9, wherein said first positioning plate includes two pairs of spaced slots located adjacent lateral edges thereof, said second positioning plate is smaller than said first positioning plate, said second positioning plate includes a pair of spaced slots located adjacent lateral edges thereof, and each pair of slots of said first and second positioning plates retaining a long belt and a pair of short belts, whereby the short belts secure the plates to the uprights and the long belts secure a user to the positioning plates.

11. The multi-exercise health apparatus of claims 8 or 10 wherein said belts comprise a strap made from hook and loop material.

12. The multi-exercise health apparatus of claim 8, further comprising a plurality of foot stands adjustably secured beneath the corners of said support.

* * * * *